US009960518B2

(12) United States Patent
Tai et al.

(10) Patent No.: US 9,960,518 B2
(45) Date of Patent: May 1, 2018

(54) ELECTRICAL CABLE CONNECTOR AND CONNECTOR ASSEMBLY THEREOF

(71) Applicant: Amphenol FCI Asia Pte Ltd, Singapore (SG)

(72) Inventors: Kenny Tai, Taoyuan (TW); Kenny Chen, Taoyuan (TW); Beer Fu, Taoyuan (TW)

(73) Assignee: Amphenol FCI Asia Pte. Ltd., KA Place (SG)

( * ) Notice: Subject to any disclaimer, the term of this patent is extended or adjusted under 35 U.S.C. 154(b) by 0 days. days.

(21) Appl. No.: 15/105,919

(22) PCT Filed: Dec. 18, 2014

(86) PCT No.: PCT/SG2014/000603
§ 371 (c)(1),
(2) Date: Jun. 17, 2016

(87) PCT Pub. No.: WO2015/094120
PCT Pub. Date: Jun. 25, 2015

(65) Prior Publication Data

US 2017/0005429 A1 Jan. 5, 2017

(30) Foreign Application Priority Data

Dec. 18, 2013 (SG) ..... 201309382-8

(51) Int. Cl.
*H01R 13/10* (2006.01)
*H01R 13/436* (2006.01)
(Continued)

(52) U.S. Cl.
CPC ..... *H01R 13/4361* (2013.01); *H01R 9/2416* (2013.01); *H01R 9/2491* (2013.01); *H01R 4/185* (2013.01)

(58) Field of Classification Search
CPC ..... H01R 13/4361
(Continued)

(56) References Cited

U.S. PATENT DOCUMENTS 2,374,971 A * 5/1945 Benander ..... H01R 13/56 174/59
2,953,765 A * 9/1960 Greasley ..... H01R 13/112 439/327
(Continued)

FOREIGN PATENT DOCUMENTS

JP 62-149176 U1 9/1987
JP H07-6801 A 1/1995
(Continued)

OTHER PUBLICATIONS

International Search Report and Written Opinion for International Application No. PCT/SG2014/000603 dated Feb. 10, 2015.
(Continued)

*Primary Examiner* — Neil Abrams
(74) *Attorney, Agent, or Firm* — Wolf, Greenfield & Sacks, P.C.

(57) ABSTRACT

Embodiments of the present invention provide high performance and reliable electrical cable connectors and connector assembly. An electrical cable connector according to one embodiment of the present invention includes a housing (110) and terminals (140) disposed in compartments (111) of the housing (110). The housing (110) has a mating face (101) for connecting to a counterpart connector, and each compartment (111) has a mating end (111*a*) adjacent to the mating face (101) and an entrance (111*b*) opposite to the mating end (111*a*). Each terminal (140) is disposed in one of the compartments (111) by being inserted into the compartment (111) from the entrance (111*b*). A cover (120) is assembled to the housing (110) to block the entrance (111*b*) of each compartment (111), such that removal of the termi-
(Continued)

nals (140) from the housing (110) through the entrance (111*b*) is prevented. The cover (120) has openings (126, 128) formed thereon to allow electrical cables (130) to pass through to connect to the terminals (140).

20 Claims, 10 Drawing Sheets

(51) Int. Cl.
*H01R 9/24* (2006.01)
*H01R 4/18* (2006.01)

(58) Field of Classification Search
USPC ..... 439/689, 685, 942, 686
See application file for complete search history.

(56) References Cited

U.S. PATENT DOCUMENTS 3,404,364 A * 10/1968 Paullus ..... H01R 13/436 439/458
4,109,992 A * 8/1978 Hughes ..... H01R 13/567 439/620.21
4,211,463 A * 7/1980 Chandler ..... H01R 13/5808 439/468
4,483,580 A * 11/1984 Pelczarski ..... H01R 13/629 439/460
4,708,662 A * 11/1987 Klein ..... H01R 13/6273 439/353
4,869,686 A * 9/1989 Michaels ..... H01R 13/5808 439/455
5,067,913 A * 11/1991 Sagawa ..... H01R 13/4223 439/595
5,100,345 A * 3/1992 Endo ..... H01R 13/506 439/592
5,259,785 A * 11/1993 Inaba ..... H01R 13/58 439/364
6,250,952 B1 * 6/2001 Shiga ..... F42B 3/188 439/466
6,425,780 B1 * 7/2002 Muhlmichel ..... H01R 13/5829 439/460
6,494,740 B1 * 12/2002 Murakami ..... H01R 13/5208 439/275
6,551,137 B2 * 4/2003 Pfaff ..... H01R 13/7031 439/108
6,666,708 B2 * 12/2003 Saito ..... H01R 12/727 439/372
6,837,733 B2 * 1/2005 Katsuma ..... H01R 13/641 439/352
6,837,745 B2 * 1/2005 Takada ..... H01R 13/562 439/521
7,086,908 B2 * 8/2006 Fukuzaki ..... H01R 13/42 439/521
7,125,284 B2 * 10/2006 Ripper ..... H01R 13/501 439/596
7,204,711 B2 * 4/2007 Garcia ..... H01R 33/09 362/249.14
7,241,183 B2 * 7/2007 Wasalaski ..... H01R 13/447 439/686
7,682,162 B2 * 3/2010 Yuan ..... H01R 12/79 439/76.1
8,192,229 B2 * 6/2012 Endo ..... H01R 13/501 439/596
8,556,650 B2 * 10/2013 Ikeda ..... H01R 13/567 439/456
8,568,159 B2 * 10/2013 Noda ..... H01R 13/562 439/470
9,065,202 B2 * 6/2015 Wu ..... H01R 13/5833
9,130,295 B2 * 9/2015 Nguyen Nhu ..... H01R 13/447
9,257,772 B2 * 2/2016 Natter ..... H01R 13/42
9,368,883 B2 * 6/2016 Chiang ..... H01R 9/0506
2002/0115335 A1 8/2002 Saito
2010/0227511 A1 9/2010 Qian
2014/0342587 A1 * 11/2014 Wu ..... H01R 13/447 439/135
2017/0005429 A1 * 1/2017 Tai ..... H01R 9/2491

FOREIGN PATENT DOCUMENTS

JP 2003-332000 A 11/2003
JP 2008-130285 A 6/2008

OTHER PUBLICATIONS

International Preliminary Report on Patentability for International Application No. PCT/SG2014/000603 dated Jun. 30, 2016.

* cited by examiner

X-X

ELECTRICAL CABLE CONNECTOR AND CONNECTOR ASSEMBLY THEREOF

RELATED APPLICATIONS

The present application is a U.S. national stage filing under 35 U.S.C. § 371 based on International Application No. PCT/SG2014/000603, filed Dec. 18, 2014, which claims the benefit of priority to Republic of Singapore Patent Application No. 201309382-8, filed on Dec. 18, 2013, each of which applications is incorporated herein by reference to the maximum extent allowable by law.

TECHNICAL FIELD

The present invention relates to an electrical connector and in particular, the present invention relates to an electrical cable connector and a cable connector assembly.

BACKGROUND OF THE INVENTION

Electrical cable connectors are used in many industrial applications to connect electrical cable to electrical devices for transmission of power and/electronic signals. High performance electrical devices require reliable electrical cable connectors to perform such connection functions which bring challenges to connector manufacturers to continuously supply high quality connectors to the industry.

SUMMARY OF THE INVENTION

Embodiments of the present invention provide high performance and reliable electrical cable connectors and cable connector assembly. An electrical cable connector according to one embodiment of the present invention includes a housing and terminals disposed in the compartments of the housing. The housing has a mating face for connecting to a counterpart connector, and each compartment has a mating end adjacent to the mating face and an entrance opposite to the mating end. Each terminal is disposed in one of the compartments by being inserted into the compartment from the entrance. A cover is assembled to the housing to block the entrance of each compartment, such that removal of the terminals from the housing through the entrance is prevented. The cover has openings formed thereon to allow electrical cables to pass through to connect to the terminals.

BRIEF DESCRIPTION OF THE DRAWINGS

These and other aspects of the present invention will be described in detail with reference to the accompanying drawings, in which.

LIST OF REFERENCE NUMERALS CORRESPONDING TO MAIN TECHNICAL FEATURES

100 connector
- 101 mating face
- 102 first direction
- 104 second direction
- 105 reference line

110 housing
- 111 first row of compartments
- 111*a* mating end
- 111*b* entrance
- 112 housing recess
- 113 second row of compartments
- 113*a* mating end
- 113*b* entrance
- 114 housing projection

120 cover
- 122 cover projection
- 124 cover recess
- 126 first set of openings
- 127 partition wall
- 128 second set of openings
- 129 back wall

130 cable
- 130*a* first rows of cables
- 130*b* second rows of cables

140 terminal
- 140*a* first row of terminals
- 140*b* second row of terminals
- 141 head portion
- 142*a* first bending portion
- 142*b* second bending portion
- 143 tail portion

DETAILED DESCRIPTION OF PREFERRED EMBODIMENTS

Figure 1A:
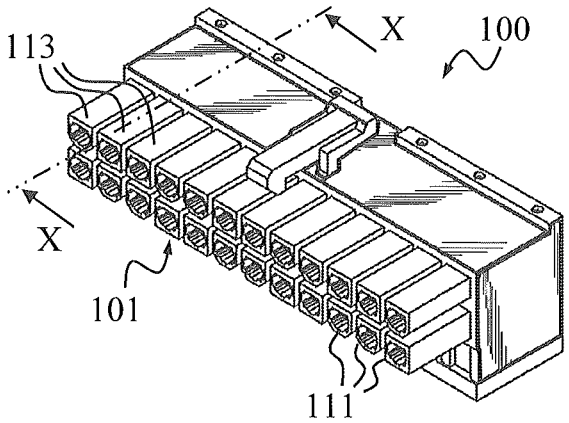
FIG. 1A is a perspective view showing an electrical cable connector according to one embodiment of the present invention.
Figure 1B:
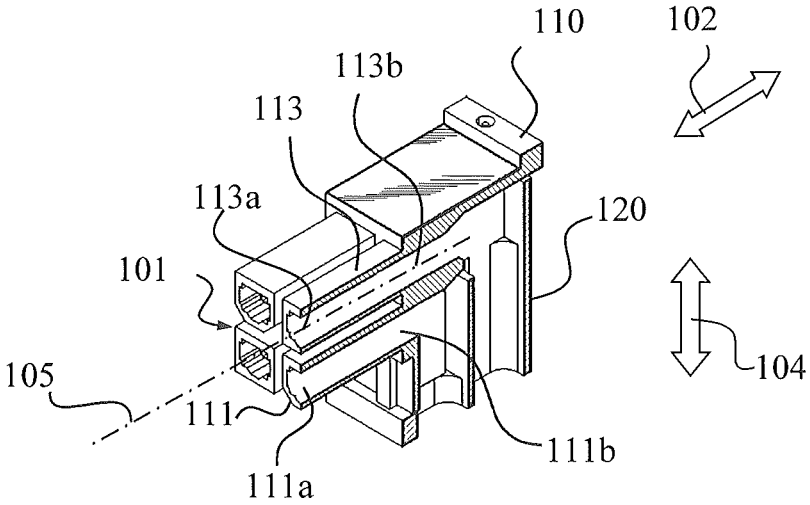
FIG. 1B is a perspective cross sectional view of FIG. 1A along X-X.

As shown in the figures, a cable connector 100 according to one embodiment of the present invention includes a housing 110 having a mating face 101 for mating with a counterpart connector (not shown in the figures), a first row of compartments 111 and a second row of compartments 113 formed therein. Each compartment 111, 113 has a mating end 111*a*, 113*a* adjacent to mating face 101, and an entrance 111*b*, 113*b* opposite to mating end 111*a*, 113*a*. Each compartment 111, 113 is aligned along a first direction 102 from mating end 111*a*, 113*a* to entrance 111*b*, 113*b*. In the context, compartment 111, 113 aligned along first direction 102 refers to a situation where, shown in FIG. 1B as an example for illustration, a reference line 105 linking mating end 113*a* and entrance 113*b* of compartment 113 is parallel to first direction. Terminals 140 are each disposed in one of the compartments 111, 113 of housing 110 along first direction 102. The connector 100 may be provided together with cables 130 connected to terminals 140, to form a connector assembly. Alternatively, in some applications connector 100 may be provided without cable but is ready for being connected to cables. Cover 120 is assembled to the back side of housing 110 along a second direction 104 which is orthogonal to first direction 102.

Figure 5:
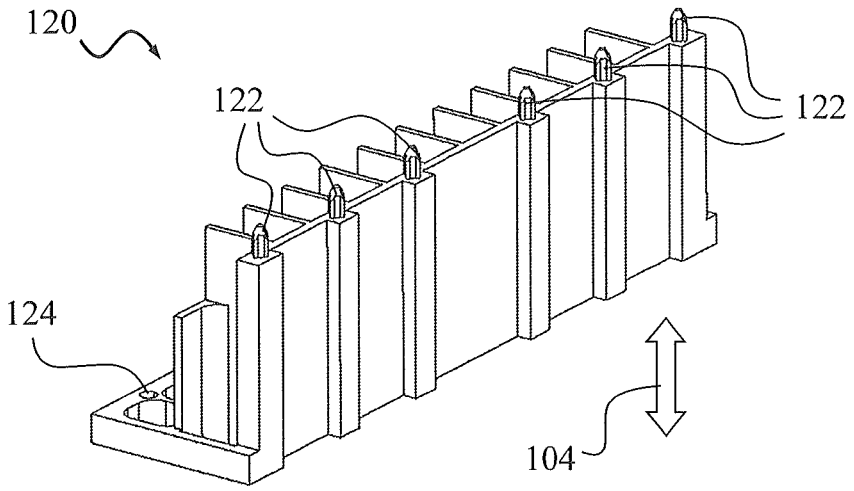
FIG. 5 is a perspective view showing the cover of the cable connector of FIG. 1A.
Figure 6:
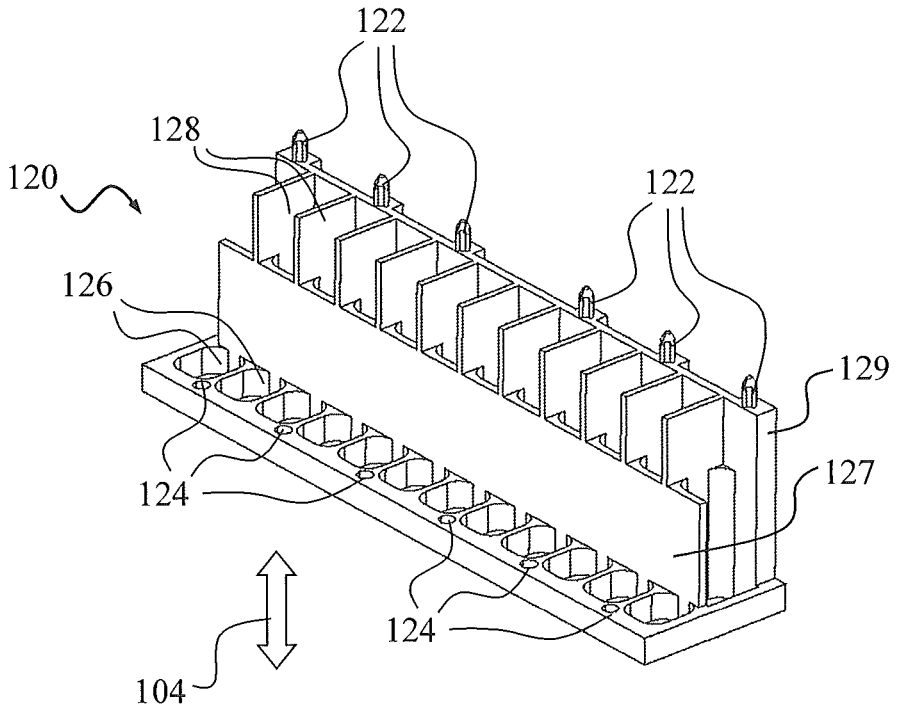
FIG. 6 shows the cover of FIG. 5 viewing from another angle.

As shown in FIGS. 5 and 6, cover 120 has a plurality of openings e.g. a first row of through holes 126, a second row of through holes 128 formed thereon. A partition wall 127 is formed between first and second rows of through holes 126 and 128. A back wall 129 is formed outside of the second row of through holes 128. When in use, cables 130 are arranged to pass through the through holes 126, 128 and connected to terminals 140.

Before cover 120 is assembled to housing 110, first and second rows of compartments 111, 113 are accessible through entrances 111*a*, 113*a*, respectively, such that the terminals 140 can be inserted into compartments 111, 113, through the entrances 111*a*, 113*a*. When cover 120 is assembled to housing 110, back wall 129 of back cover 120 is positioned to block entrance 113*a* of the second row of compartments 113, and partition wall 127 is positioned to block entrance 111*a* of the first row of compartments 111. Accordingly, terminals 140 are retained in compartments 111, 113 and prevented from being removed from housing 110 through the respective entrance 111*a*, 113*a*, along first direction 102.

Figure 1C:
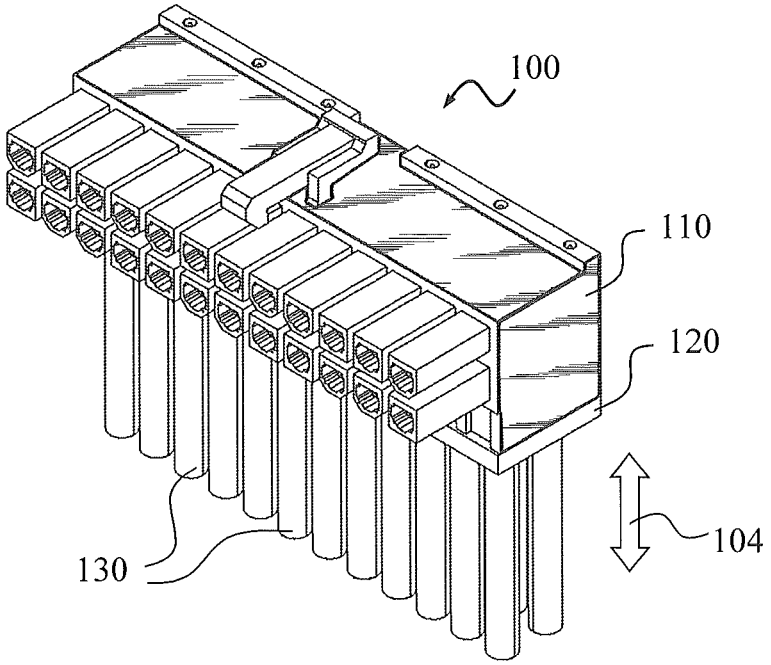
FIG. 1C is a perspective view of FIG. 1A when connected to electrical cables to form a cable connector assembly.
Figure 2:
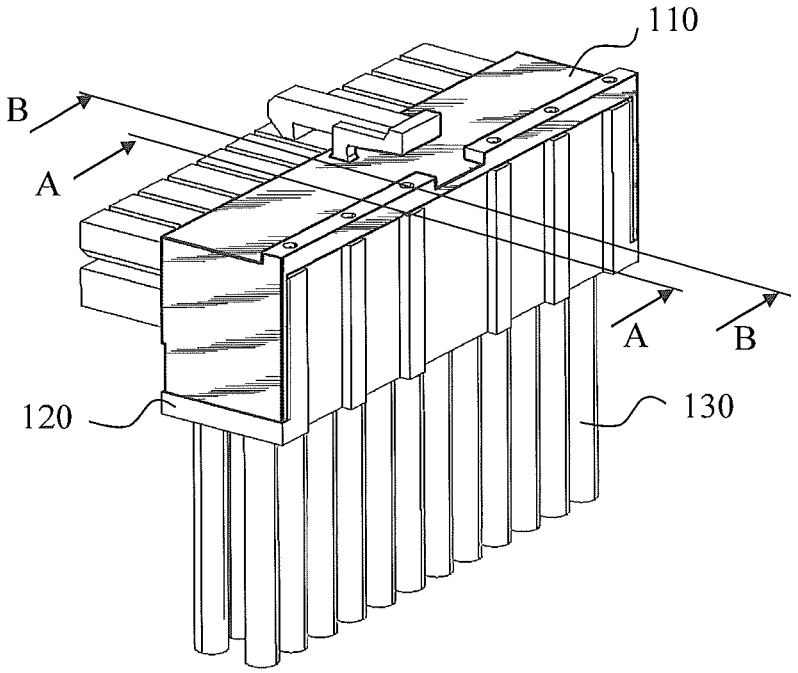
FIG. 2 shows the cable connector assembly of FIG. 1C viewing from another angle.
Figure 3:
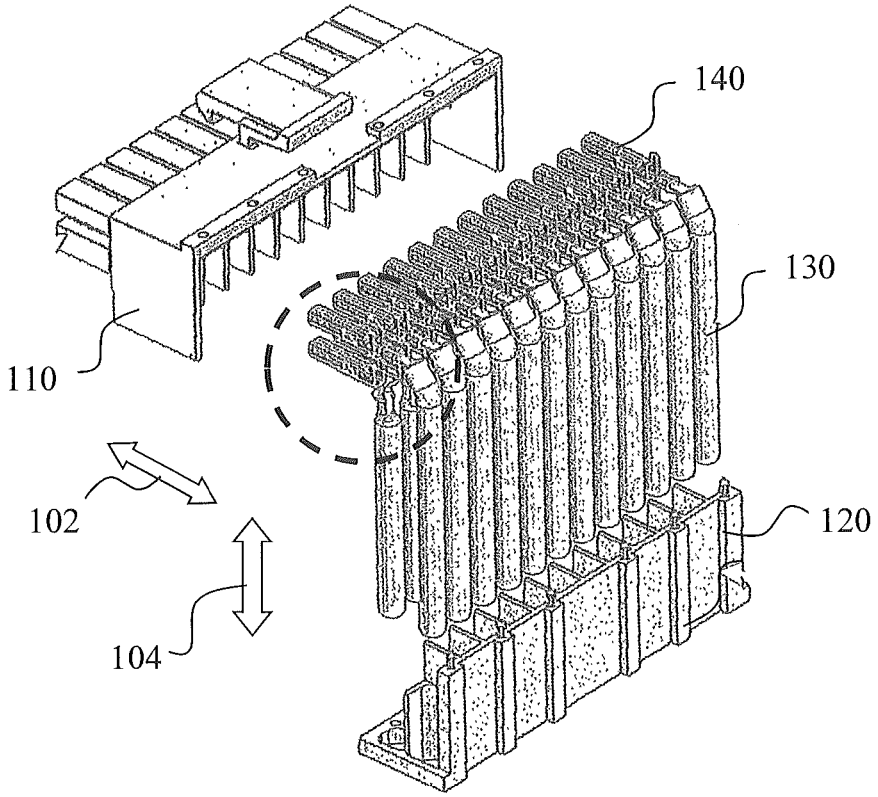
FIG. 3 is an exploded view of FIG. 2.

In the present embodiment, connector 100 may also be provided together with cables 130, each being connected to a respective terminal 140. Upon completion of the assembling process, the cables are aligned along second direction 104, and passing through the through holes 126 and 128 of cover 120, as shown in FIGS. 1C, 2 and 3.

Figure 4:
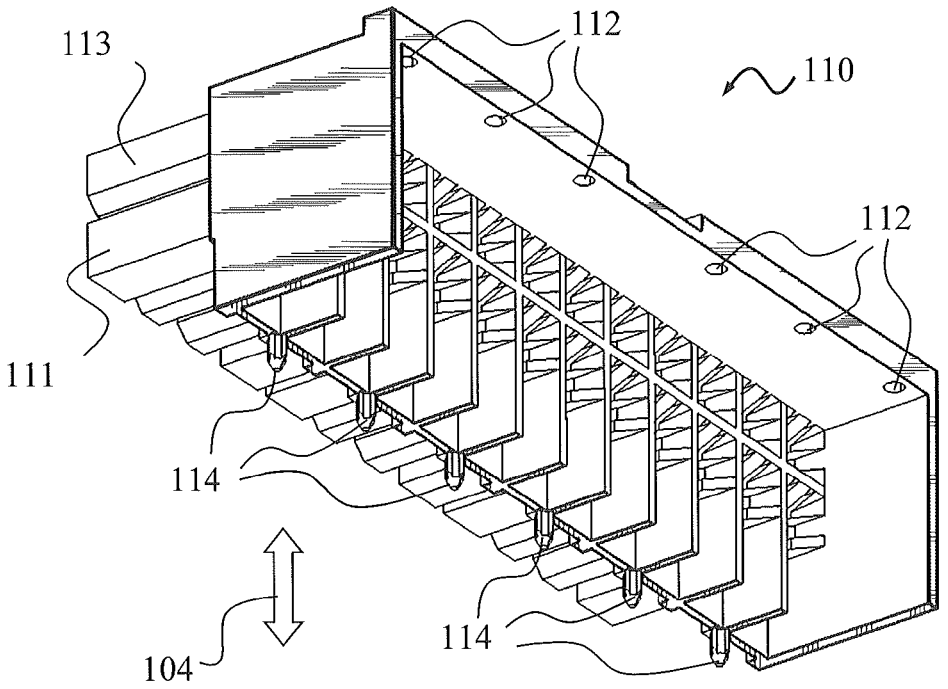
FIG. 4 is a perspective view showing the housing of the electrical cable connector of FIG. 1A.

Further shown in FIGS. 4, 5 and 6, housing 110 has retaining members formed integral to housing 110. In the present embodiment, retaining members include housing recesses 112 formed at a top portion of housing 110, and housing projections 114 formed at a bottom portion of housing 110, extending downwardly. Both the housing recesses 112 and housing projections 114 are oriented along second direction 104. Cover 120 has fastening members formed integral thereto. In the present embodiment, fastening members include cover projections 122 formed at a top portion of cover 120, extending upwardly, and cover recesses 124 formed at a bottom portion of cover 120. Both the cover projections 122 and cover recesses 124 are also oriented along second direction 104. The dimensions, pitches and numbers of housing recesses 112 and the dimensions, pitches and numbers of cover projections 122 are configured to match each other.

Figure 7:
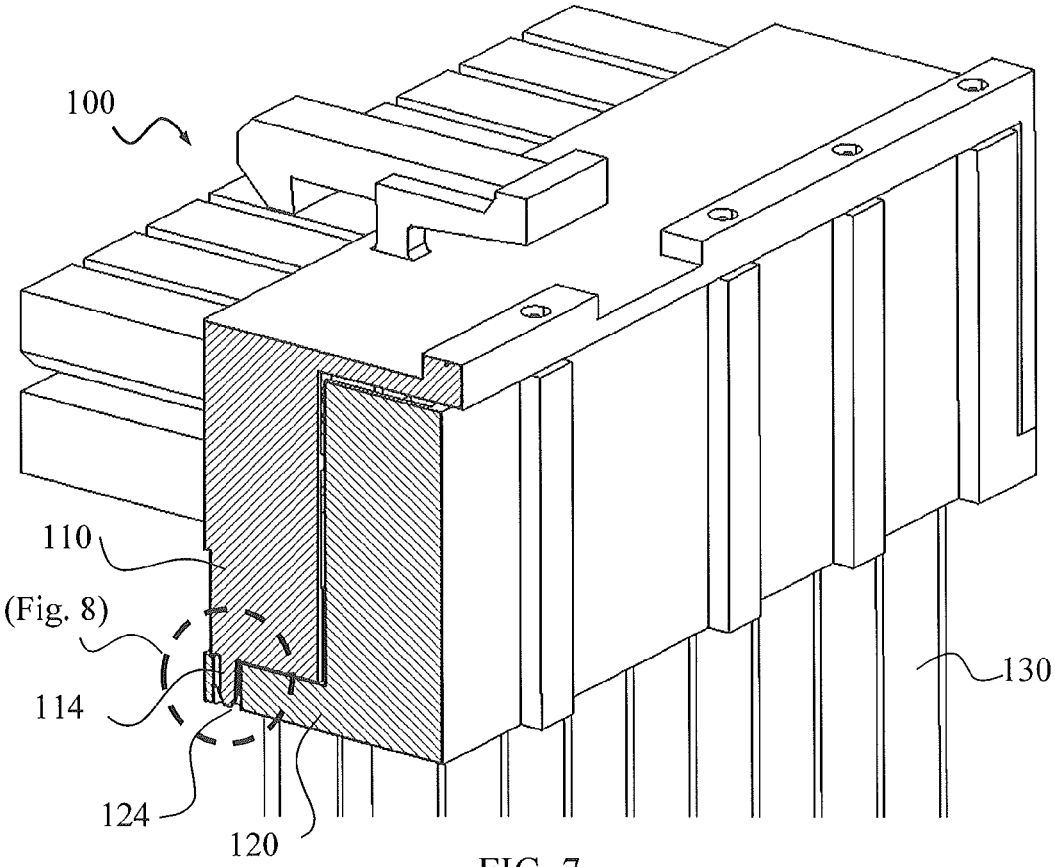
FIG. 7 is a perspective cross-sectional view of FIG. 2 along A-A.
Figure 8:
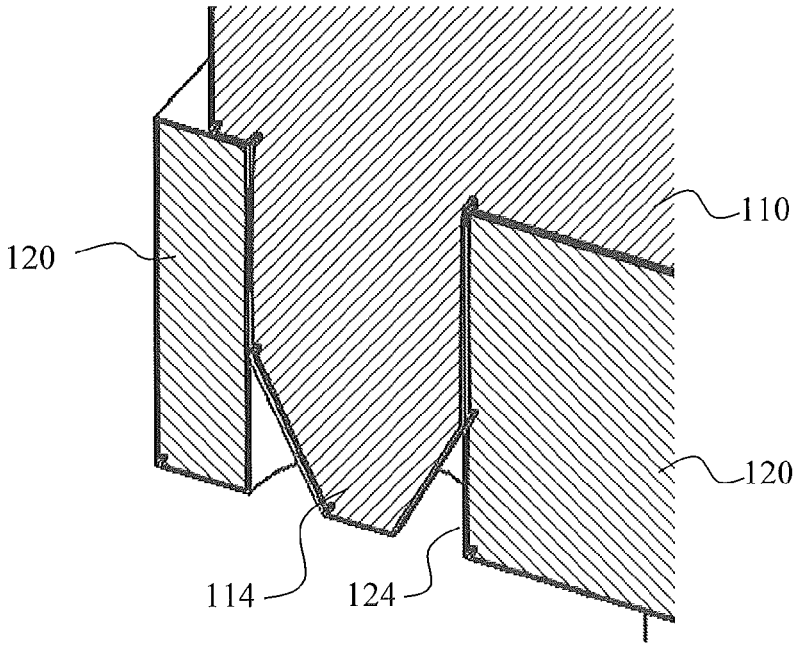
FIG. 8 is an enlarged partial view of FIG. 7.

Housing projections 114 each has a cross-sectional external dimension e.g. a diameter slightly larger than the bore diameter of a corresponding cover recess 124. Likewise, the dimensions and pitches of housing projections 114 and the dimensions and pitches of cover recesses 124 are configured to match each other. Cover projections 122 each has a cross-sectional external dimension e.g. a diameter slightly larger than the bore diameter of a corresponding housing recess 112. Accordingly, when cover 120 is assembled to housing 110, housing projections 114 are inserted into cover recesses 124 (FIGS. 7 and 8), in an interference-fit manner. In the meantime, cover projections 122 are also inserted into housing recesses 112 (FIGS. 9 and 10), in an interference-fit manner. Assembling in this way, cover 120 and housing 110 can be easily attached to and tightly fixed to each other. Movement of the cover 120 relative to the housing 110 along the first direction 102 is prevented.

Figure 9:
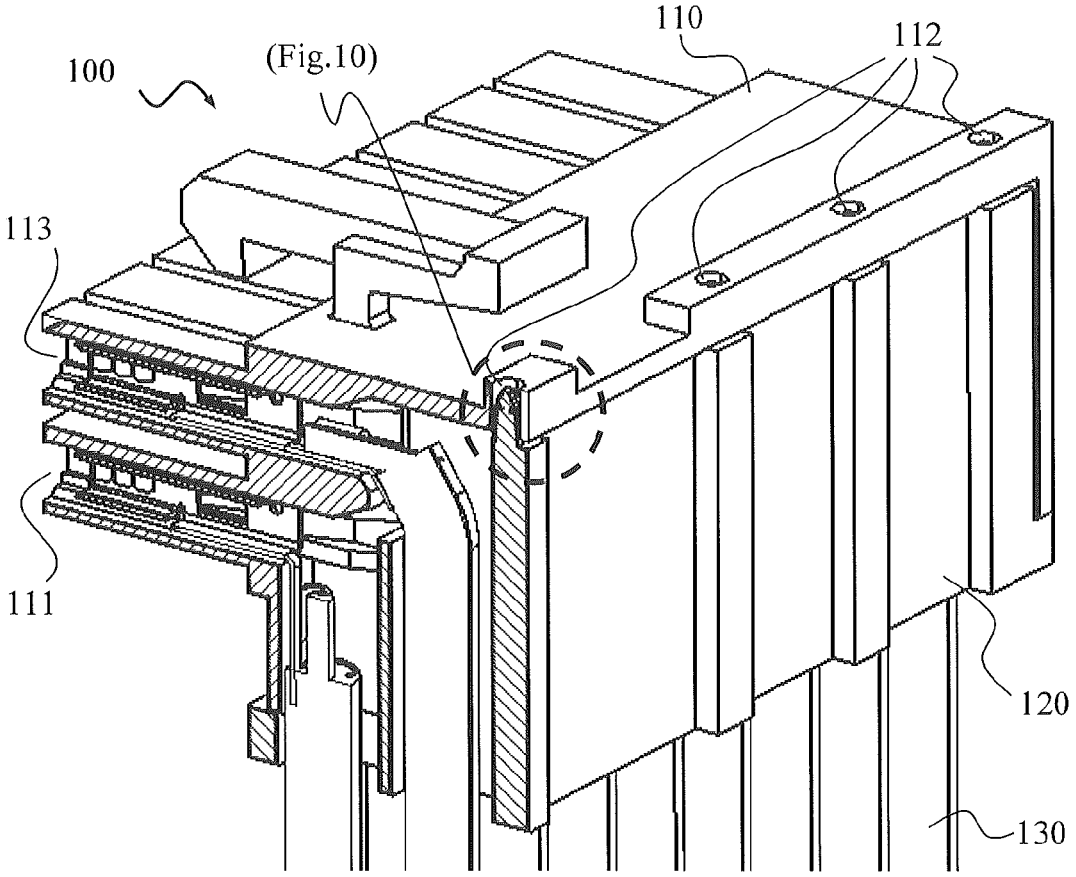
FIG. 9 is a perspective cross-sectional view of FIG. 2 along B-B.
Figure 10:
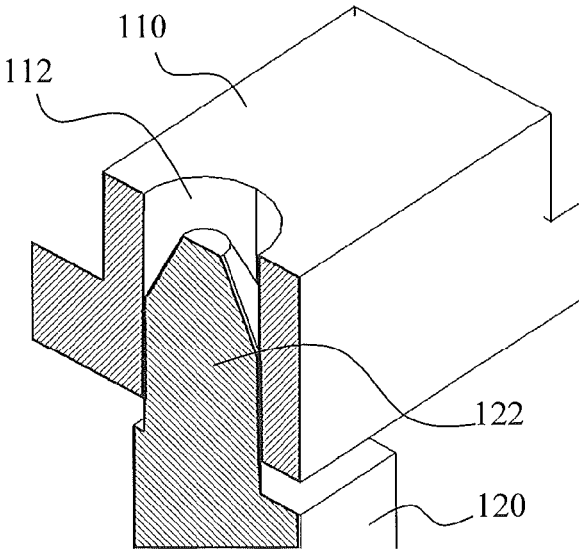
FIG. 10 is an enlarged partial view of FIG. 9.
Figure 11:
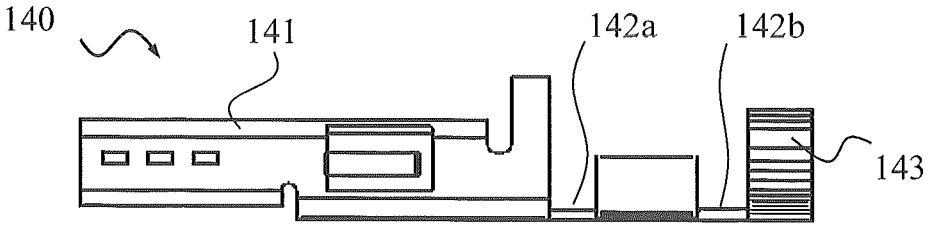
FIG. 11 is a side view of the terminal of the cable connector shown in FIG. 1A, before attached to a cable.
Figure 12:
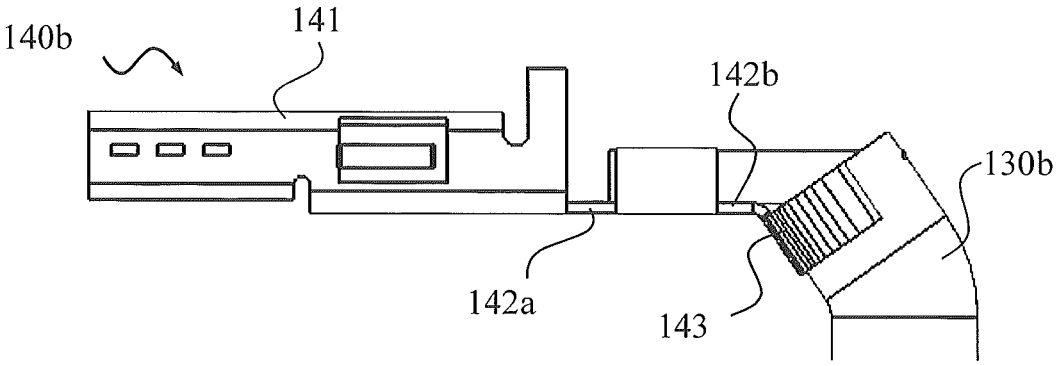
FIG. 12 is a side view of the terminal of FIG. 11 after being attached to a cable of a second row of the connector.
Figure 13:
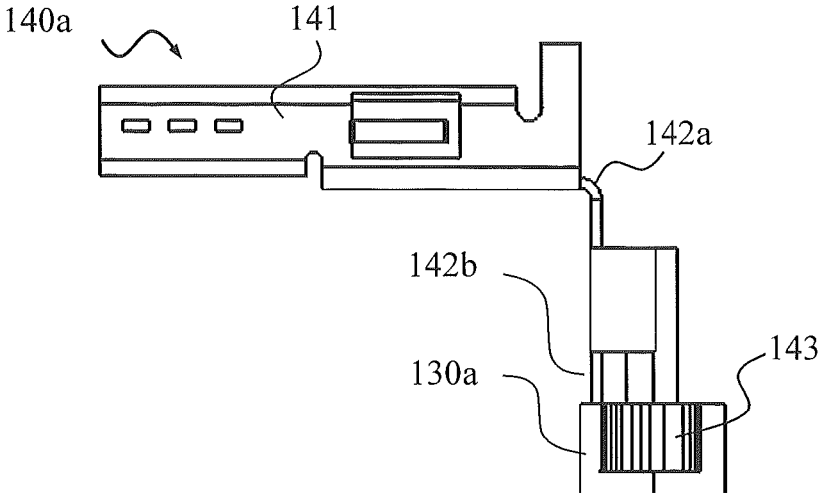
FIG. 13 is a side view of the terminal of FIG. 11 after being attached to a cable of a first row of the connector.

As shown in FIG. 11, each terminal 140 has a head portion 141 to be fixed to a corresponding compartment of the housing (not shown), and a tail portion 143 for connecting to a cable. Terminal 140 has a first link portion 142*a* and a second link portion 142*b* between head portion 141 and tail portion 143. Terminal 140 with same structure, shape and dimensions may be used in both the lower row compartments 111 and upper row compartments 113 of housing 110 (FIGS. 3, 9).

Figure 14:
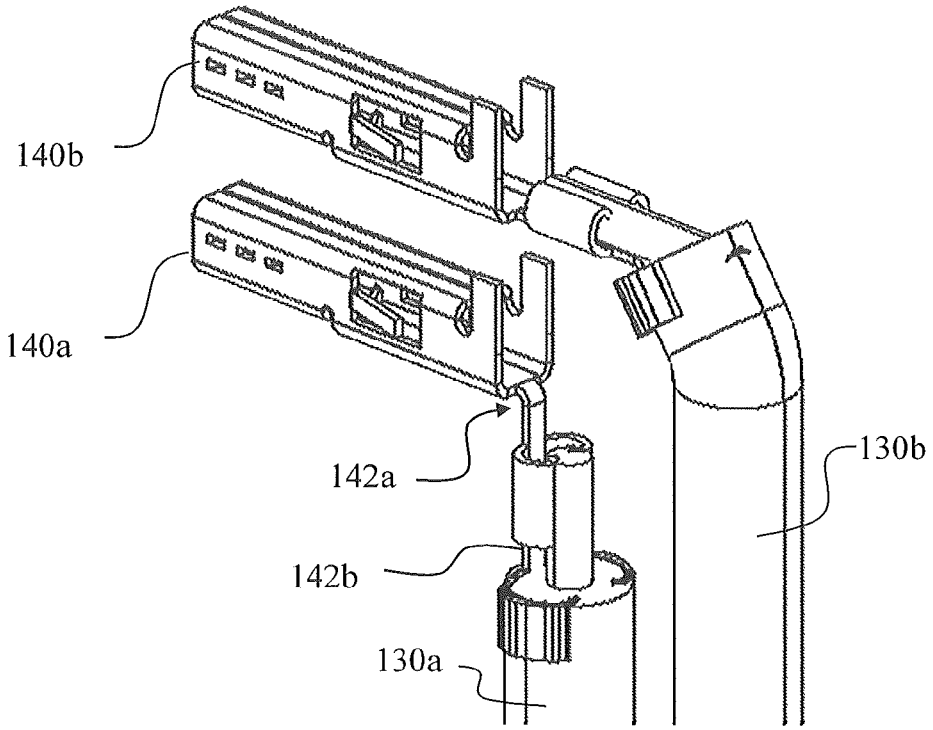
FIG. 14 is an enlarged partial view of FIG. 3 showing the cable-terminal connection structure.
Figure 15:
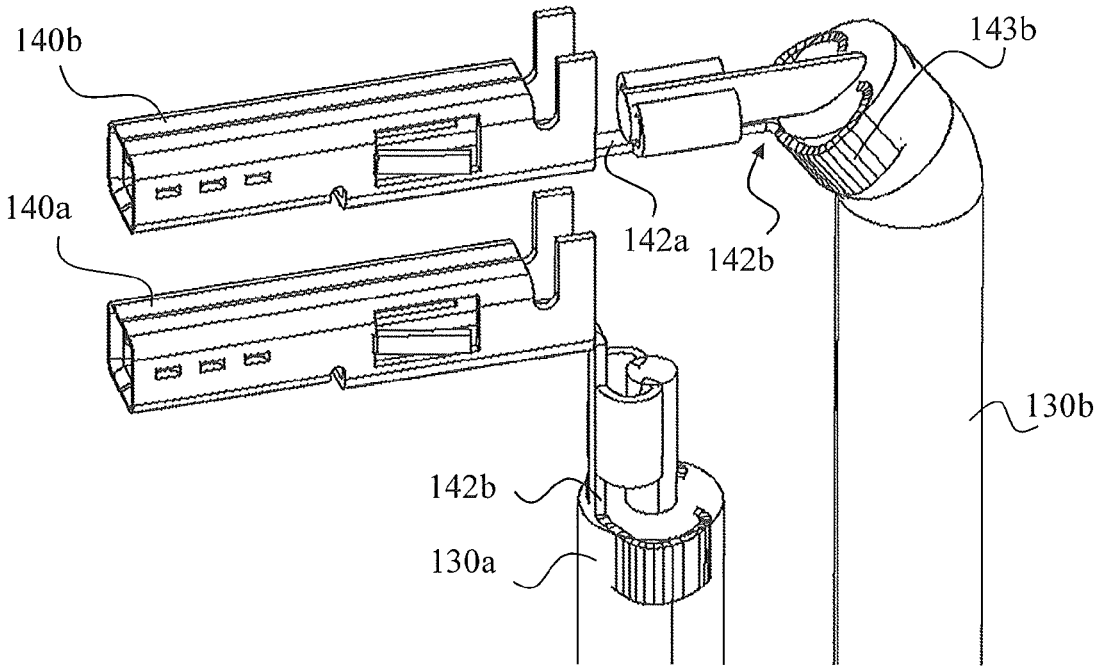
FIG. 15 shows the cable-terminal connection structure of FIG. 11 viewing from another angle.
Figure 16:
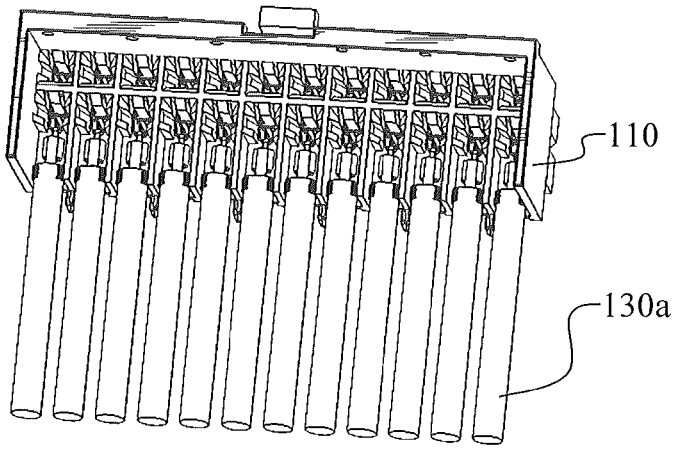
FIG. 16 to 18 are perspective views showing main steps of the assembling process of the connector.
Figure 19:
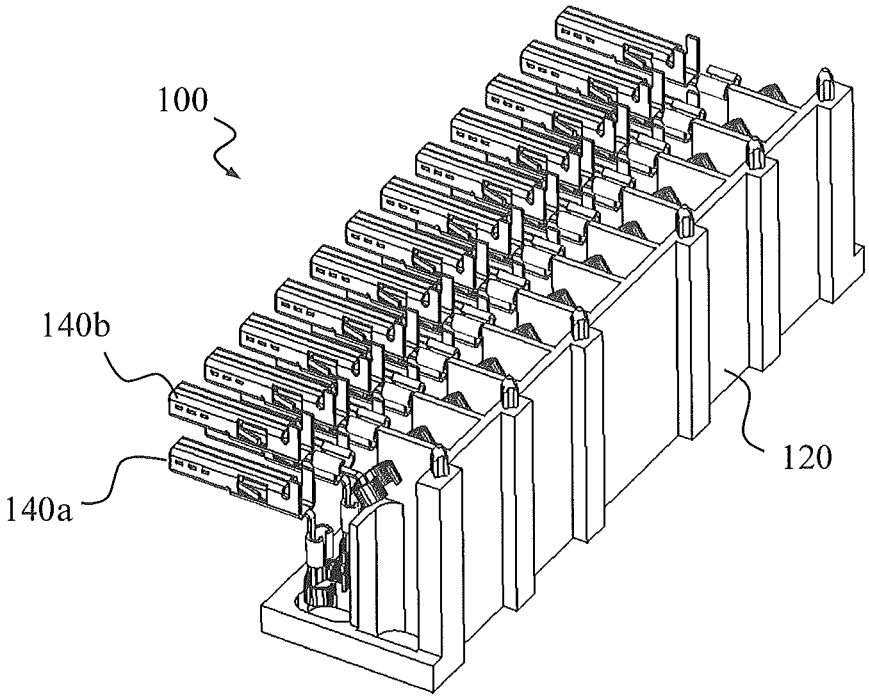
FIG. 19 shows the connector of FIG. 1A viewing from another angle and with the housing omitted.
Figure 20:
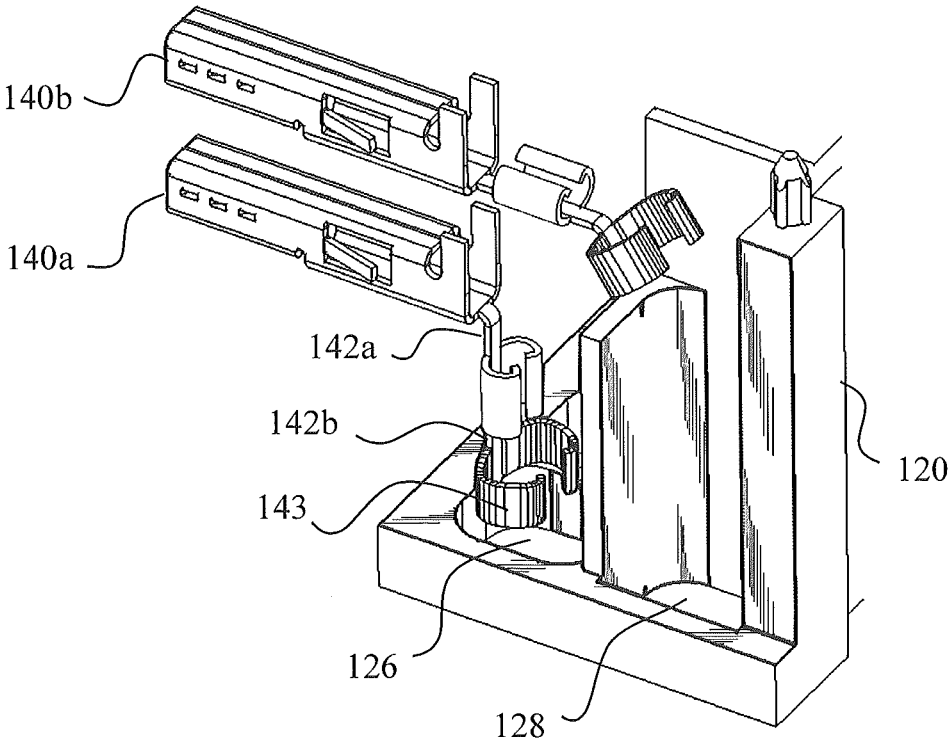
FIG. 20 is a partial enlarges view of FIG. 19.

Cover 120 has first and second rows of through holes 126, 128 formed thereon, as depicted in FIG. 5 and FIG. 6. To connect the cables to the terminals, each of the first rows of cables 130*a* firstly passes through a corresponding through hole 126 of cover 120, and is attached to a corresponding terminal, by crimping one of the first row of terminals 140*a* to cable 130*a*. Terminal 140*a* is bent at first link portion 142*a* such that cables 130*a* are aligned perpendicularly with respect to the head portion 141 of terminal 140*a*, as shown in FIGS. 14, 15 and 16. As further shown in FIGS. 19 and 20, when first row of terminals 140*a* are disposed in the housing and with cover 120 attached in place, second link portion 142*b* of terminals 140*a* is in alignment with through hole 126 of cover 120. Further, tail portion 143 is in alignment with through hole 126 of cover 120.

Figure 17:
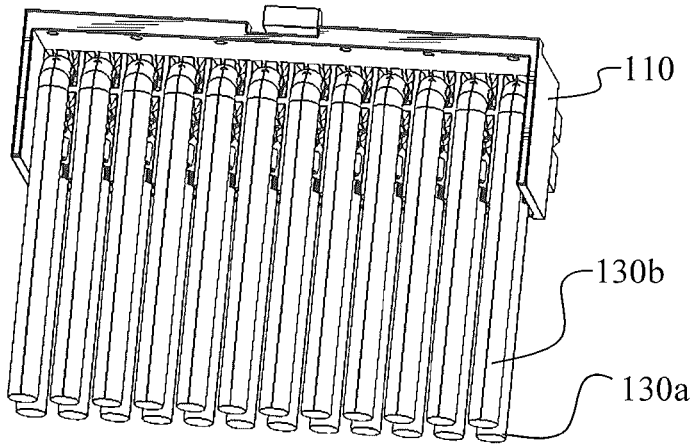

After the first row of cables 130*a* are assembled to the connector, each of the second rows of cables 130*b* firstly passes through a corresponding through hole 128 of cover 120, and is attached to a corresponding terminal, by crimping to a corresponding one of the second row of terminals 140*b*. Thereafter, each of the second row of terminals 140*b* is bent at second link portion 142*b*, such that tail portion 143 of terminal 140*b* becomes angled with respect to head portion 141, to enable easy crimping of cable 130*b* to terminal 140*a*. The second row of cables 130*b* can therefore be further bent with an appropriate angle, and aligned perpendicularly with respect to the head portion 141, as shown in FIGS. 14, 15 and 17.

Figure 18:
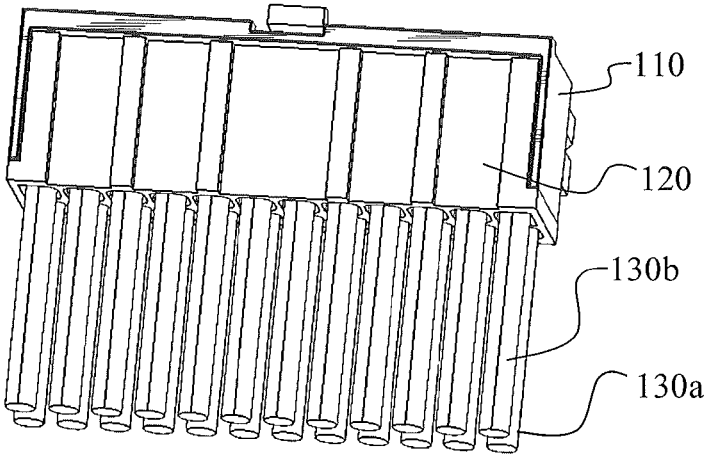

After the first row of cables 130*a* and the second row of cables 130*b* are connected to respective terminals 140*a*, 140*b*, cover 120 is assembled to housing 110, to complete the assembly process, as shown in FIG. 18. Having first link portion and second link portion, terminals 140 of a single structure and dimension is well suitable for being assembled in different rows/positions of a connector housing, by deforming one of the link portions to enable proper arrangement and alignment of the terminals and the cables. Manufacturing process of terminals for connectors according to embodiments of the present invention is simplified, and cost is lowered.

Although embodiments of the present invention have been illustrated in conjunction with the accompanying drawings and described in the foregoing detailed description, it should be appreciated that the present invention is not limited to the embodiments disclosed. Therefore, the present invention should be understood to be capable of numerous rearrangements, modifications, alternatives and substitutions without departing from the spirit of the invention as set forth and recited by the following claims.

The invention claimed is:

1. An electrical cable connector comprising:

a housing having a mating face and a plurality of compartments, each compartment having a mating end adjacent to the mating face and an entrance opposite to the mating end;

a plurality of terminals each being disposed in one of the compartments;

a cover to allow a plurality of cables to pass through to connect to the terminals, wherein the cover comprises a plurality of openings, each opening of the plurality of openings comprising a through hole and being associated with a terminal from the plurality of terminals such that a cable from the plurality of cables can pass through the opening to connect to the associated terminal, wherein the cover being assembled to the housing to block the entrance of each compartment by which removal of the terminals from the housing through the entrance is prevented; and wherein each of the compartments is aligned along a first direction from the mating end to the entrance, and the cover is assembled to the housing along a second direction orthogonal to the first direction to block the entrance of each compartment.

2. The electrical cable connector as recited in claim 1, wherein the housing includes a retaining member and the cover includes a fastening member, and wherein the cover is assembled to the housing through the engagement of the fastening member and the retaining member by which movement of the cover relative to the housing along the first direction is prevented.

3. The electrical cable connector as recited in claim 2, wherein the retaining member includes a plurality of first recesses and first projections, and the fastening member includes a plurality of second recesses and second projections, wherein each of the first projections is received in one of a corresponding second the recesses and each of the second projections is received in one of a corresponding first recesses by which the cover is assembled to the housing.

4. The electrical cable connector as recited in claim 3, wherein each of the first projections and second projections has an outer diameter slightly greater than an inner dimension of the corresponding first recesses and second recesses by which the engagement of the fastening member and the retaining member being of a interference-fit manner to secure the cover to the housing.

5. The electrical cable connector as recited in claim 1, wherein each terminal has a head portion at one end for mating with a counterpart connector, a tail portion at an opposite end for connecting to a cable, and a first and a second link portions between the head portion and the tail portion, wherein one of the first and the second link portions is deformed by which the head portion and the tail portion are angled with respect to each other.

6. The electrical cable connector as recited in claim 5, wherein the compartments includes a first group of compartments arranged along a first row of the housing and a second group of compartment arranged along a second row of the housing, wherein the cover includes a partition wall blocking the entrance of each of the first group of compartments, and a back wall blocking the entrance of the second group of compartments, and wherein the first link portion of each of the terminals disposed in a corresponding one of the first group of compartments is deformed, and the second link portion of each of the terminals disposed in a corresponding one of the second group of compartments is deformed.

7. The electrical cable connector as recited in claim 6, wherein the plurality of openings of the cover includes a first group of openings arranged along a first row and a second group of openings arranged along a second row, wherein the partition wall is positioned between the first group of openings and the second group of openings, and the second group of openings are positioned between the partition wall and the back wall.

8. The electrical cable connector as recited in claim 7, wherein the second link portion of each of the terminals disposed in one of the first group of compartments is in alignment with a corresponding first group of openings of the cover.

9. The electrical cable connector as recited in claim 8, wherein the tail portion of each of the terminals disposed in one of the first group of compartments is in alignment with a corresponding first group of openings of the cover.

10. An electrical connector assembly comprising:

a housing having a plurality of compartments;

a plurality of terminals each being disposed in one of the plurality of compartments;

a plurality of cables each being attached to one of the plurality of terminals; and a cover through which the plurality of cables pass, the cover being attached to the housing to block an entrance of each compartment by which removal of the terminals from the housing through the entrance is prevented, wherein each terminal is aligned along a first direction of the housing, and each cable is aligned along a second direction of the housing orthogonal to the first direction, and wherein the cover is assembled to the housing along the second direction to prevent each terminal from being removed from the housing through the entrance of each compartment;

wherein the housing includes a retaining member that includes a plurality of first recesses and first projections and the cover includes a fastening member that includes a plurality of second recesses and second projections, and wherein the cover is assembled to the housing through the engagement of the fastening member and the retaining member such that each of the first projections is received in one of a corresponding second recesses and each of the second projections is received in one of a corresponding first recesses, by which movement of the cover relative to the housing along the first direction is prevented.

11. The electrical cable connector as recited in claim 10, wherein each of the first projections and second projections has an outer dimension slightly greater than an inner dimension of the corresponding first recesses and second recesses by which the engagement of the fastening member and the retaining member being of a interference-fit manner to secure the cover to the housing.

12. The electrical cable connector as recited in claim 10, wherein each terminal has a head portion at one end for mating with a counterpart connector, a tail portion at an opposite end for connecting to a cable, and a first and a second link portions between the head portion and the tail portion, wherein one of the first and the second link portions is deformed by which the head portion and the tail portion are angled with respect to each other.

13. The electrical cable connector as recited in claim 12, wherein the compartments includes a first group of compartments arranged along a first row of the housing and a second group of compartment arranged along a second row of the housing, wherein the cover includes a partition wall blocking the entrance of each of the first group of compartments, and a back wall blocking the entrance of each of the second group of compartments, and wherein the first link portion of each of the terminals disposed in a corresponding one of the first group of compartments is deformed, and the second link portion of each of the terminals disposed in a corresponding one of the second group of compartments is deformed.

14. The electrical cable connector as recited in claim 13, wherein the cover includes a first group of openings arranged along a first row and a second group of openings arranged along a second row, wherein the partition wall is positioned between the first group of openings and the second group of openings, and the second group of openings are positioned between the partition wall and the back wall.

15. The electrical cable connector as recited in claim 14, wherein the second link portion of each of the terminals disposed in one of the first group of compartments is in alignment with a corresponding first group of openings of the cover.

16. The electrical cable connector as recited in claim 14, wherein the tail portion of each of the terminals disposed in one of the first group of compartments is in alignment with a corresponding first group of openings of the cover.

17. An electrical cable connector comprising:

a housing having:

a mating face and a plurality of compartments, each compartment having a mating end adjacent to the mating face and an entrance opposite to the mating end; and a plurality of first recesses and first projections;

a plurality of terminals each being disposed in one of the compartments; and a cover to allow a plurality of cables to pass through to connect to the terminals, the cover comprising a plurality of second recesses and second projections;

wherein each of the first projections is received in one of a corresponding second recesses and each of the second projections is received in one of a corresponding first recesses, by which the cover is assembled to the housing to block the entrance of each compartment by which removal of the terminals from the housing through the entrance is prevented.

18. The electrical cable connector of claim 17, wherein each of the plurality of compartments is aligned along a first direction from the mating end to the entrance, and the cover is assembled to the housing along a second direction orthogonal to the first direction to block the entrance of each compartment.

19. The electrical cable connector of claim 17, wherein each terminal has a head portion at one end for mating with a counterpart connector, a tail portion at an opposite end for connecting to a cable, and a first and a second link portions between the head portion and the tail portion, wherein one of the first and the second link portions is deformed by which the head portion and the tail portion are angled with respect to each other.

20. The electrical cable connector of claim 19, wherein each of the plurality of compartments includes a first group of compartments arranged along a first row of the housing and a second group of compartment arranged along a second row of the housing, wherein the cover includes a partition wall blocking the entrance of each of the first group of compartments, and a back wall blocking the entrance of the second group of compartments, and wherein the first link portion of each of the terminals disposed in a corresponding one of the first group of compartments is deformed, and the second link portion of each of the terminals disposed in a corresponding one of the second group of compartments is deformed.

* * * * *